US005816989A

United States Patent [19]

Marcum

[11] Patent Number: 5,816,989

[45] Date of Patent: Oct. 6, 1998

[54] SELF-RETAINING EXERCISE/PHYSICAL THERAPY DEVICE

[76] Inventor: Martie S. Marcum, 334 W. Huron St., Milford, Mich. 48281

[21] Appl. No.: 920,222

[22] Filed: Aug. 25, 1997

[51] Int. Cl.[6] ..... A63B 21/00

[52] U.S. Cl. ..... 482/111; 482/110; 482/106

[58] Field of Search ..... 482/111, 110, 482/907, 148, 106–108

[56] References Cited

U.S. PATENT DOCUMENTS

| | | | |
|---|---|---|---|
| 4,109,906 | 8/1978 | Wilson | 482/110 |
| 4,378,113 | 3/1983 | Piccini | 482/110 |
| 5,312,314 | 5/1994 | Stephan et al. | 482/110 |
| 5,478,312 | 12/1995 | Weissbuch | 482/111 |

*Primary Examiner*—Jerome Donnelly
*Attorney, Agent, or Firm*—Brooks & Kushman P.C.

[57] ABSTRACT

An exercise and/or physical therapy device which has legs for self-retaining the device on a human body adjacent to the muscle to be exercised while the muscle is being exercised. Each leg is configured to adhere to the body so that the device is retained without further manual assistance to stay in the position where the user initially places it. One leg embodiment is weighted and cone-shaped with a non-skid surface. Another leg embodiment is U-shaped and bendable. The device includes a flexible, slightly arched, hollow tube containing multiple fluids having different flow characteristics when the tube is moved.

11 Claims, 3 Drawing Sheets

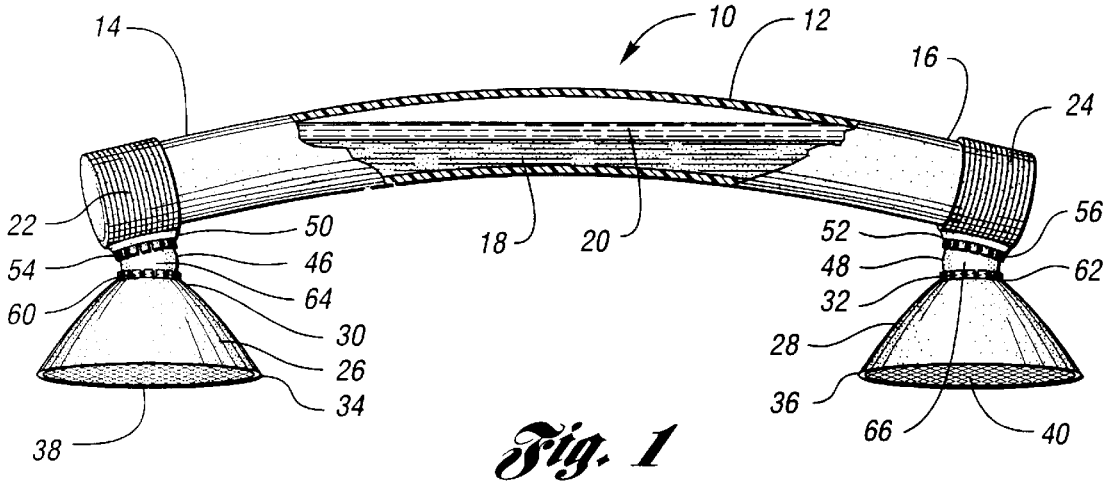
Fig. 1
Fig. 2
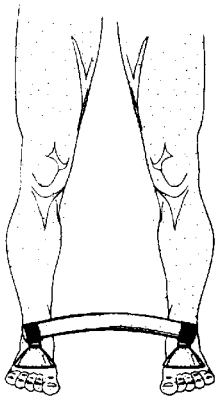
Fig. 3
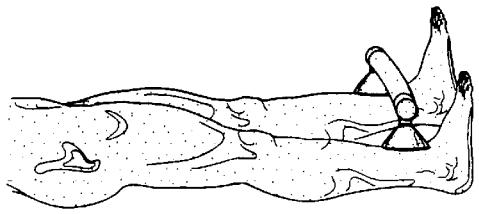
Fig. 4
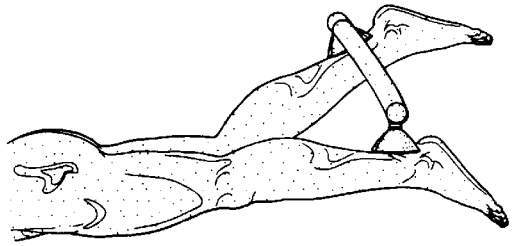
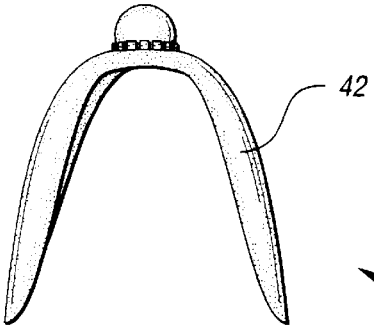
Fig. 5
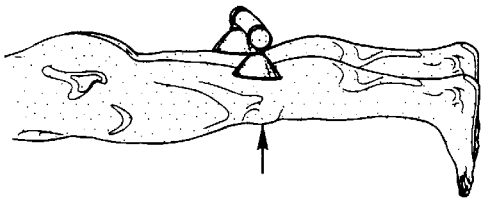
Fig. 21
Fig. 6
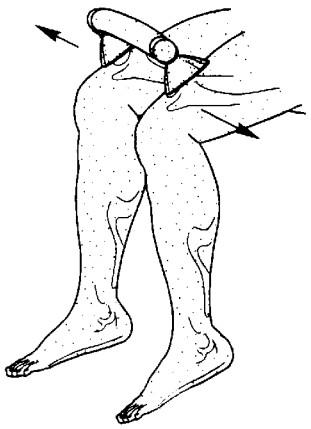
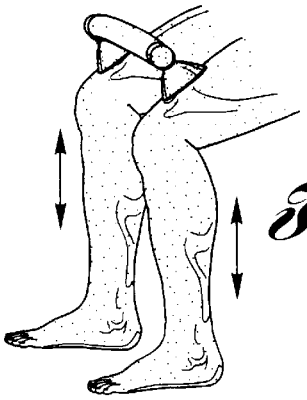
Fig. 7

Fig. 8
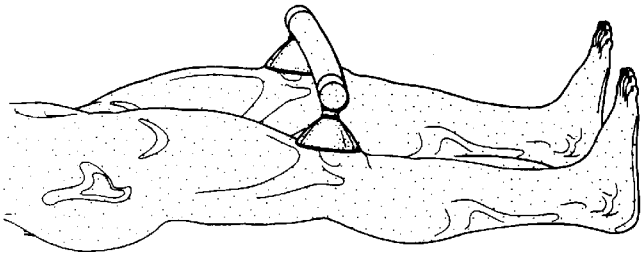
Fig. 9
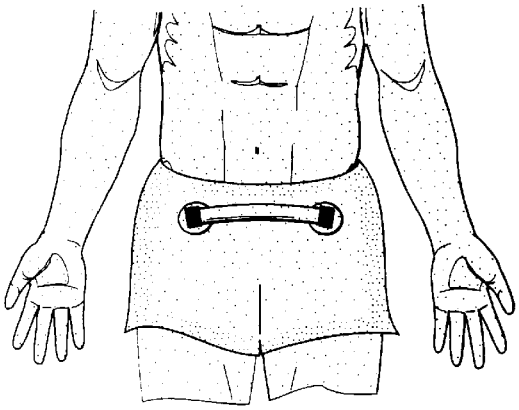
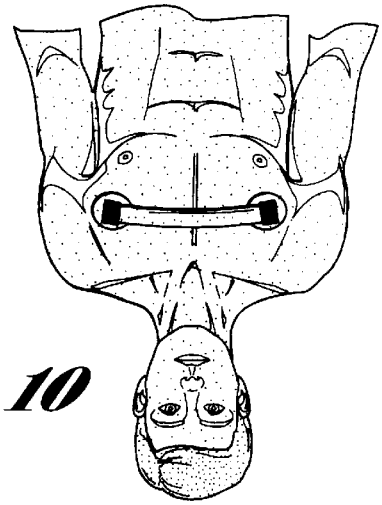
Fig. 10
Fig. 11
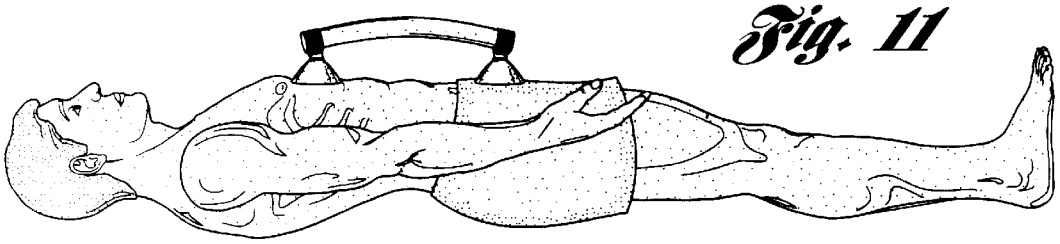
Fig. 12
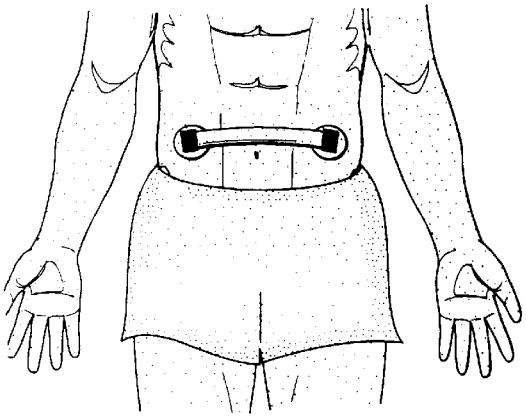
Fig. 13
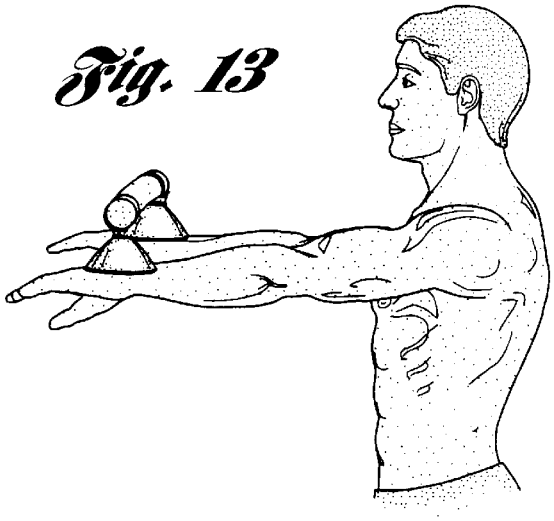

SELF-RETAINING EXERCISE/PHYSICAL THERAPY DEVICE

TECHNICAL FIELD

The present invention relates to a device for exercising and strengthening muscles of a body without straining the muscles.

BACKGROUND ART

Healthy and injured individuals exercise muscles with the aid of supplemental devices. It has been known to use devices filled with non-gaseous, flowable material to enhance the results of exercising. For example, Johnson U.S. Pat. No. 3,756,592 issued Sep. 4, 1973, describes an exercise apparatus comprised of a hollow container partially filled with a fluent mass such as sand and having rigid handles for a user to hold while manipulating the device. Piccini U.S. Pat. No. 4,378,113 issued Mar. 29, 1983, discloses a device for warming up an athlete's wrists which includes a hollow club filled with non-gaseous flowable material, preferably water. Blome U.S. Pat. 4,659,078 issued Apr. 21, 1987, discloses an exercise device having a partially liquid-filled flexible enclosure with two handle assemblies to be gripped by hand. Carlisle U.S. Pat. No. 4,685,665 issued Aug. 11, 1987, discloses a hand exercising device constructed of thermoplastic sheet material having two chambers filled with fluid that can be shifted from one chamber to the other through a narrow passageway that is offset from the center of the device. Hull U.S. Pat. No. 4,986,535 issued Jan. 22, 1991, discloses a therapeutic and exercise device which is substantially a two-step hollow ladder partially filed with a viscous fluid and containing ballast such as ball bearings. Amesquita U.S. Pat. No. 5,244,445 discloses an exercise wand including a hollow tube closed at each end and containing a plurality of movable spheres. Matthews U.S. Pat. No. 5,364,325 issued Nov. 15, 1994, discloses an exercise/physical therapy device comprised of a cell tube which may be artistically colored and which encloses a plurality of weighted spheres within a fluent material. Fischer U.S. Pat. No. 5,393,285 issued Feb. 28, 1995, describes an exercise device having a rigid body defining a chamber with at least one fluid movable within the chamber and one or more handles for gripping the device by one or two hands during exercise.

A problem with such prior art exercise devices is that they can only be used to exercise certain dedicated body parts. For example, a device may only be used to exercise the upper body muscles so that multiple devices are needed to exercise the whole body. Moreover, these prior art devices lack legs which are configured to permit the user to mount or locate the device adjacent the muscle to be exercised and strengthened and then to retain the device where mounted or located.

SUMMARY OF THE INVENTION

According to the present invention an exercise/physical therapy device is configured to straddle numerous different muscles in the body of a healthy or injured person by retaining itself adjacent the selected muscle once the device has been positioned. The device is used to strengthen muscles without straining muscles.

The device is comprised of a flexible, slightly arched, hollow elongated tube. There are two legs attached, one at each end of the tube. The legs are mounted to the elongated tube with ball joints so the legs can adjust to conform to the configuration or shape of various portions of the user's body.

In one embodiment, the legs are conical in shape. Each leg is attached to the ball joint at its narrower end. The wider end of each conically shaped leg has a flat, non-skid surface to grip the body adjacent the muscle to be exercised. In another embodiment the legs are U-shaped and bendable to facilitate the ability of the exercise device to maintain its position adjacent the muscle during exercise. It is this gripping ability of such legs with respect to the user's body portion that gives the device the ability to self-retain itself on the body portion.

Within the hollow elongated tube are immiscible fluids such as lighter weight water and heavier weight oil which flow in response to forces exerted upon the device while exercising the muscle adjacent the device.

Accordingly, it is an object of the present invention to provide an improved exercise/physical therapy device that is positionable and self-retainable at different locations on the human body to exercise and strengthen the muscles at each of such different locations.

A more specific object of this invention is the provision of an exercise/physical therapy device for exercising and strengthening the muscles of a body without straining the muscles which included a flexible, slightly arched, hollow elongated tube having a first end and a second end. A plurality of fluids are enclosed in the hollow of the elongated tube. End caps attach respectively to the first end and second end of the elongated tube for retaining the first and second fluids in the hollow. A pair of legs are configured to grip the body adjacent the muscle to be exercised and strengthened whereby to retain the device on the body, and an attachment assembly mounts the legs on said elongated tube by attaching respectively to the end caps.

BRIEF DESCRIPTION OF THE DRAWINGS

FIG. 1 is a perspective view of the exercise/physical therapy device showing as one embodiment a weighted leg assembly at each end of the device which is configured to grippingly retain the device at an exercise position on a body portion being exercised;

FIG. 2 is a pictorial view showing a body portion utilizing the exercise/physical therapy device to exercise and strengthen an adjacent muscle by raising toes or foot to flex legs and calves;

FIG. 3 is a pictorial view showing a prone body portion utilizing the exercise/physical therapy device to exercise and strengthen an adjacent muscle by raising heels from floor while lying face up;

FIG. 4 is a pictorial view showing a prone body portion utilizing the exercise/physical therapy device to exercise and strengthen an adjacent muscle by raising heels from the floor while lying face down;

FIG. 5 is a pictorial view showing a prone body portion utilizing the exercise/physical therapy device to exercise and strengthen an adjacent muscle by raising the knees off the floor while facing down and with the toes pointed and on the floor;

FIG. 6 is a pictorial view showing a sitting body portion utilizing the exercise/physical therapy device to exercise and strengthen an adjacent muscle by moving the knees sideways left and right while seated and with the buttocks in place and with each foot on the ball of each foot;

FIG. 7 is a pictorial view showing a sitting body portion utilizing the exercise/physical therapy device to exercise and strengthen an adjacent muscle while raising the knees alternately repeatedly while in a sitting position;

FIG. 8 is a pictorial view showing a prone body portion utilizing the exercise/physical therapy device to exercise and strengthen an adjacent muscle while lying face up on the floor and raising knees only;

FIG. 9 is a pictorial view showing a prone body portion utilizing the exercise/physical therapy device to exercise and strengthen an adjacent muscle while lying face up on the floor and by raising first one hip and then the other in an alternating manner;

FIG. 10 is a pictorial view showing a prone male body portion utilizing the exercise/physical therapy device to exercise and strengthen an adjacent pectoral muscle while lying face up and flexing the chest muscles alternately;

FIG. 11 is a pictorial view showing a body portion utilizing the exercise/physical therapy device on the upper and lower diaphragm to exercise and strengthen an adjacent muscle with upper body elevated or while propped upwardly on elbows and by flexing the upper and lower diaphragm upwardly and downwardly;

FIG. 12 is a pictorial view showing a prone body portion utilizing the exercise/physical therapy device to exercise and strengthen an adjacent muscle while lying flat on the floor and by flexing the diaphragm side to side and pulling in the ribs left to right;

FIG. 13 is a pictorial view showing a body portion utilizing the exercise/physical therapy device to exercise and strengthen an adjacent muscle with the body portion standing and arms extended out from the shoulders while alternately lifting the device with alternate hands;

FIG. 21 is a perspective view of another embodiment of a leg assembly suitable for attachment at each end of the exercise device of this invention to hold the device in position.

DETAILED DESCRIPTION OF THE PREFERRED EMBODIMENTS

Figure 14:
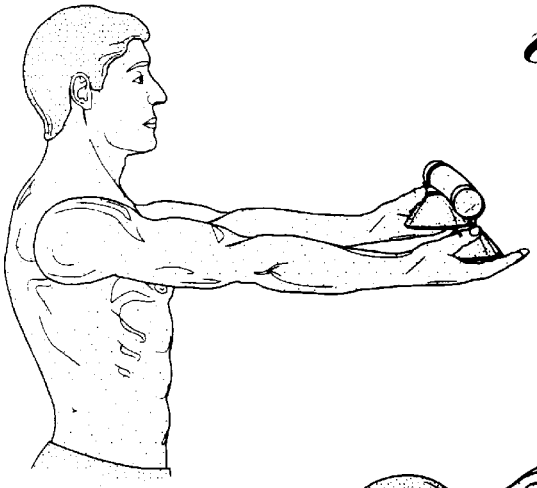
FIG. 14 is a pictorial view showing an upright body portion utilizing the exercise/physical therapy device to exercise and strengthen an adjacent muscle with the palms up and holding the arms straight and lifting the arms alternately.

FIG. 1 shows an exercise/physical therapy device 10. The device is comprised of an elongated tube of ten to twelve inches in length. The tube 12 is circular and clear and slightly arched or bridged between a first end 14 and a second end 16. The hollow of the tube 12 is filled with three fluids. A light water fluid 20 is one constituent as is a heavy weight oil 18 as a second constituent. The third fluid 19 is air which fills the remainder of the tube hollow not filled by the water and oil. The three fluids are contained within the hollow by a first end cap 22 and a second end cap 24. The end caps 22 and 24 may be threadedly adapted to screw onto opposite ends of the tube.

Figure 15:
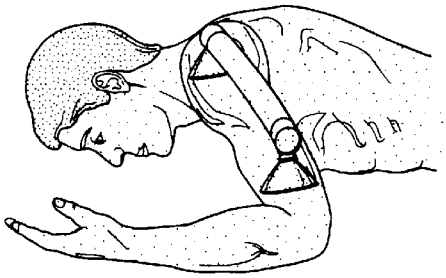
FIG. 15 is a pictorial view showing a prone body portion utilizing the exercise/physical therapy device to exercise and strengthen an adjacent muscle while lying flat face down (as shown) or face up and keeping the front or back respectively firmly on the floor and by raising only an elbow when the device is on the upper side of the arm.
Figure 16:
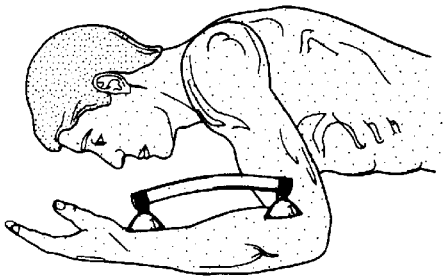
FIG. 16 is a pictorial view showing a prone body portion utilizing the exercise/physical therapy device to exercise and strengthen an adjacent muscle while lying either face down (as shown) or face up and with the arm flat on the floor and by raising an elbow and hand alternately when the device is on the upper side of the arm.
Figure 17:
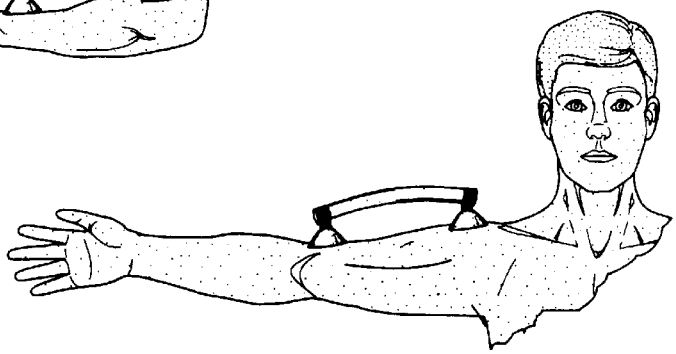
FIG. 17 is a pictorial view showing an upright body portion utilizing the exercise/physical therapy device to exercise and strengthen an adjacent muscle while standing straight and holding the arm outwardly in place and by raising the arm up and down.
Figure 18:
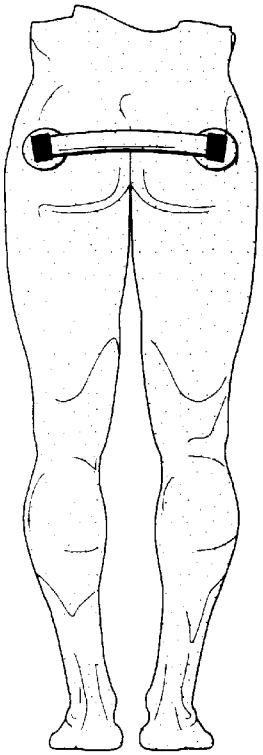
FIG. 18 is a pictorial view showing a prone body portion utilizing the exercise/physical therapy device to exercise and strengthen an adjacent muscle while lying flat with the tummy in place face down and by flexing the buttock muscles left to right.
Figure 19:
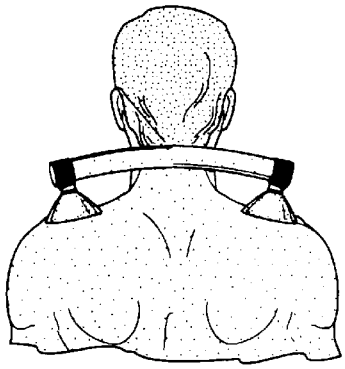
FIG. 19 is a pictorial view showing a body portion utilizing the exercise/physical therapy device to exercise and strengthen an adjacent muscle behind the neck and by rotating the shoulders upwardly and downwardly.
Figure 20:
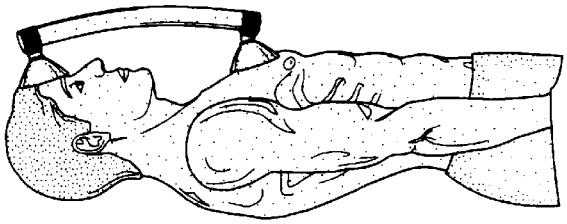
FIG. 20 is a pictorial view showing a prone body portion utilizing the exercise/physical therapy device to exercise and strengthen an adjacent muscle while lying face down or face up (as shown) and by raising the head upwardly and downwardly while the device is in place between the chest and forehead or between the back of the head and the back.

The exercise/physical therapy device includes a leg at each end thereof which is configured to grip a body portion adjacent the muscle to be exercised and strengthened. In one embodiment the leg assembly includes a bell shaped or conically shaped leg 26, 28. Each leg has a narrow end 30, 32 and a wider circular end 34, 36. The bottom 38, 40 of each leg has a flat non-skid surface adapted by such surface to grip a body portion adjacent the muscles to be strengthened so that the device will remain in place once positioned on the body portion as shown in FIGS. 2–20.

In a second embodiment as seen in FIG. 21, the leg such as 42 can be configured as a soft bendable plastic or bendable alloy so that it can straddle or flank a body portion while positioning the exercise device adjacent the muscle to be strengthened.

Each leg mounts to an end of the elongated tube by an attachment assembly 46, 48. Each attachment assembly 46, 48 has a first portion 50, 52 connected respectively to the end caps 22 and 24. On the attachment assembly 46, 48 are ball joint types of universal connections. Each includes gripping tabs 54, 56 at the portion which is connected to the end caps. The weighted legs include a second portion 60, 62 of the attachment assembly which includes gripping tabs for gripping a ball 64, 66. The ball may be part of either the attachment assembly connected to the end caps or the attachment assembly connected to the legs. In both leg embodiments of this invention the ball is shown associated with the leg so that the elongated tube can be connected to its legs simply by snapping the ball into the tabs on the end caps.

In the FIG. 21 embodiment the legs are bendable to conform to the body portion to which the device is to be attached.

The heavier weight fluid is slow moving and designed to be non-mixing with either the air or the lighter weight non-mixing solution such as water. It may also be a different color than the water to create an appealing visual effect as the solution moves back and forth in the hollow of the elongated tube during an exercise program. The fluid should also be non-toxic.

In particular, the elongated tube may have dimensions which are conveniently configured to straddle the various muscles to be strengthened and exercised. In one particularly suitable embodiment the elongated tube may be about eleven inches long and two inches in diameter. The end caps in addition to threading over the two inch round may be approximately a half inch in length as each threads onto its respective end of the hollow tube. The narrow end of each weighted leg is about one inch in diameter and the ball in the attachment assembly is about one and one half inches in diameter. The flat non-skid surface on the first embodiment leg is approximately two and one half inches in diameter.

The legs are interchangeable so that the leg assembly can be popped or snapped in or out of the gripping tabs in the attachment assembly at each end of the hollow tube.

FIGS. 2–20 illustrate the various positions for the exercise physical therapy device on the human body. The various locations shown in these figures are representative of body portions to which the non-skid surface of the weighted leg adheres while the exercises are being performed. The non-skid surface may be textured such as the sole of a tennis shoe or a rubber or rubber-like jar opener. Importantly, it should be sufficiently adherent to the skin surface of a body portion that the exercise device stays in position on the body portion throughout the exercise or therapy program. The leg may be weighted by sand or water placed in the hollow of the conical leg. One suitable leg could be a food storage container such as Tupperware, with the snap-on cover being removable to fill the container with sand or water to weight the leg. The leg may also be formed of metal such as steel to weight the leg without a filler.

In those areas where the non-skid surface is inappropriate, the second embodiment leg may be used. In the case of the second embodiment, the leg can be bent around body portions such as ankles and legs and arms to solidly grip the body portion adjacent the muscle to be exercised. With either leg embodiment it is the configuration of the leg which self-retains the device on the body portion after the device has been positioned in a desired location.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. An exercise/physical therapy device for exercising and strengthening the muscles of a body without straining the muscles, said device comprising:

a flexible, slightly arched, hollow elongated tube having a first end and a second end;

a first fluid in the hollow of said elongated tube;

a first end cap and a second end cap attached respectively to the first end and a second end of said elongated tube retaining said first fluid in said hollow;

at least one leg configured to grip the body adjacent the muscle to be exercised and strengthened; and an attachment assembly for mounting said one leg at said first end of said elongated tube.

2. The exercise/physical therapy device of claim 1 further comprising a second fluid in the hollow of said elongated tube that is immiscible with said first fluid in the hollow of said elongated tube.

3. The exercise/physical therapy device of claim 1 wherein said one leg is configured as a weighted cone having a narrower end and a wider end;

said attachment assembly includes a ball joint having one portion mounted to said narrower end of said weighted cone and another portion mounted at said first end of said elongated tube; and said wider end of said weighted cone including a non-skid surface sufficiently conformable to grip the body in a non-skid manner adjacent the muscle to be exercised and strengthened.

4. The exercise/physical therapy device of claim 1 wherein said one leg has a U-shape having a closed end and an open end;

said attachment assembly includes a ball joint having one portion mounted to said closed end of the U-shape and another portion mounted at said first end of said elongated tube; and said open end of said U-shape being configured to straddle the body and bendable to grip the body adjacent the muscle to be exercised and strengthened.

5. The exercise/physical therapy device of claim 1 wherein the attachment assembly for mounting said one leg is connected to said first end cap.

6. The exercise/physical therapy device of claim 1 including another leg configured to grip the body adjacent the muscle to be exercised and strengthened; and another attachment assembly for mounting said other leg at said second end of said elongated tube.

7. The exercise/physical therapy device of claim 6 wherein said other leg is configured as a second weighted cone having a narrower end and a wider end;

said other attachment assembly includes a ball joint having one portion mounted to said narrower end of said second weighted cone and another portion mounted at said second end of said elongated tube; and said wider end of said second weighted cone comprising a non-skid surface sufficiently conformable to grip the body in a non-skid manner adjacent the muscle to be exercised and strengthened.

8. The exercise/physical therapy device of claim 6 wherein said other leg is configured as a second U-shaped having a closed end and an open end;

said other attachment assembly includes a ball joint having one portion mounted to said closed end of the second U-shape and another portion mounted at said second end of said elongated tube; and said open end of said second U-shape being configured to grip the body adjacent the muscle to be exercised and strengthened.

9. The exercise/physical therapy device of claim 6 wherein the other attachment assembly for mounting said other leg is connected to said second end cap.

10. The exercise/physical therapy device of claim 1 wherein said attachment assembly includes a pair of gripping tabs connected respectively to said first end of said tube and said one leg and a ball in snapped-in relationship to each of said gripping tabs for mounting said one leg at said first end of said elongated tube.

11. A self-retaining exercise/physical therapy device for exercising and strengthening the muscles of a body without straining the muscles, said device comprising:

a flexible, slightly arched, hollow elongated tube having a first end and a second end;

a first fluid in the hollow of said elongated tube;

a first end cap and a second end cap attached respectively to the first end and a second end of said elongated tube retaining said first fluid in said hollow;

at least one leg configured to grip the body sufficiently adjacent the muscle to be exercised and strengthened that the device is self-retained on the body during the exercise or physical therapy; and an attachment assembly for mounting said one leg at said first end of said elongated tube.

* * * * *